United States Patent [19]

Smith

[11] 4,006,820

[45] Feb. 8, 1977

[54] MIXING CONTAINER

[75] Inventor: Ernest L. Smith, Kansas City, Mo.

[73] Assignee: Phillips Petroleum Company, Bartlesville, Del.

[22] Filed: July 31, 1975

[21] Appl. No.: 600,550

Related U.S. Application Data

[63] Continuation of Ser. No. 364,920, May 29, 1973, abandoned.

[52] U.S. Cl. ..... 206/219; 229/43

[51] Int. Cl.[2] ..... B65D 25/08

[58] Field of Search ..... 220/23, 20; 206/219, 206/217; 229/43

[56] References Cited

UNITED STATES PATENTS

| | | | |
|---|---|---|---|
| 766,587 | 8/1904 | Bradshaw | 206/219 |
| 816,338 | 3/1906 | Kimsey | 229/5.8 |
| 1,644,821 | 10/1927 | Eckart | 220/23 |
| 1,765,383 | 6/1930 | Punte | 220/82 |
| 1,885,757 | 11/1932 | Orlopp | 206/219 |
| 3,185,341 | 5/1965 | Barbour | 220/306 |
| 3,305,368 | 2/1967 | Bourelle | 206/219 |
| 3,425,845 | 2/1969 | Dunn | 220/23 |
| 3,731,853 | 5/1973 | Baumann | 206/219 |

FOREIGN PATENTS OR APPLICATIONS

| | | | |
|---|---|---|---|
| 127,630 | 10/1945 | Australia | 220/23 |

*Primary Examiner*—R. E. Hart

[57] ABSTRACT

A mixing container having a recessed portion with a concave vessel nested in said recessed portion, said vessel having a bottom with an opening extending therethrough with said bottom being in contact with the recessed portion of the container.

15 Claims, 2 Drawing Figures

MIXING CONTAINER

This is a continuation of application Ser. No. 364,920, filed May 29, 1973, and now abandoned.

It is desirable to provide a mixing container having a measuring vessel connected thereto for filling the vessel with one material, opening the container in communication with the vessel, and thereafter passing material from the vessel into contact with material in the container. One example, among many, would be dry dog food, packaged in the container with a preselected volume of water added to the dog food in the container through the opening of the vessel.

This invention, therefore, resides in a mixing container having a recessed portion with a concave vessel nested in said recessed portion, said vessel having a bottom with an opening extending therethrough with said bottom being in contact with the recessed portion of the container.

Other aspects, objects, and advantages of the present invention will become apparent from a study of the disclosure, the appended claims, and the drawings.

The drawings are diagrammatic views of the example mixing container of this invention.

Figure 1:
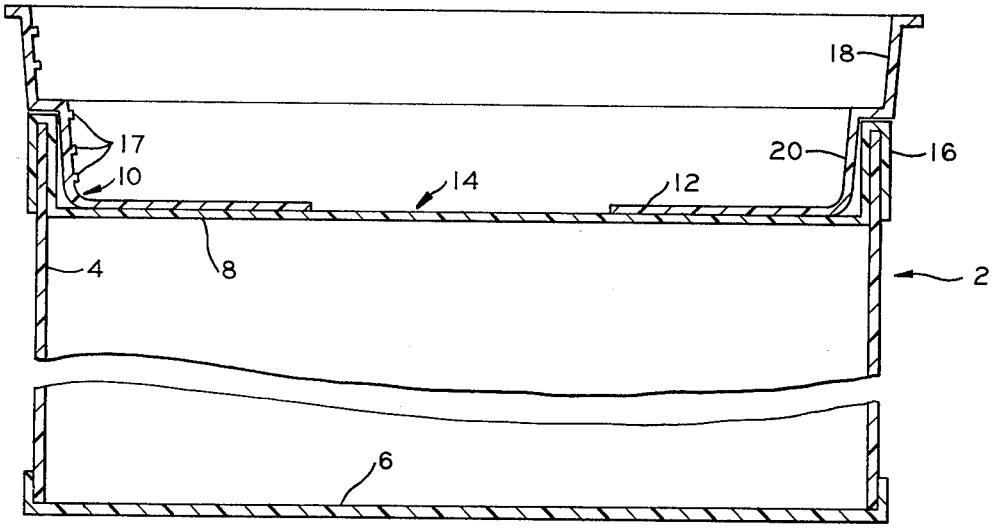
Figure 2:
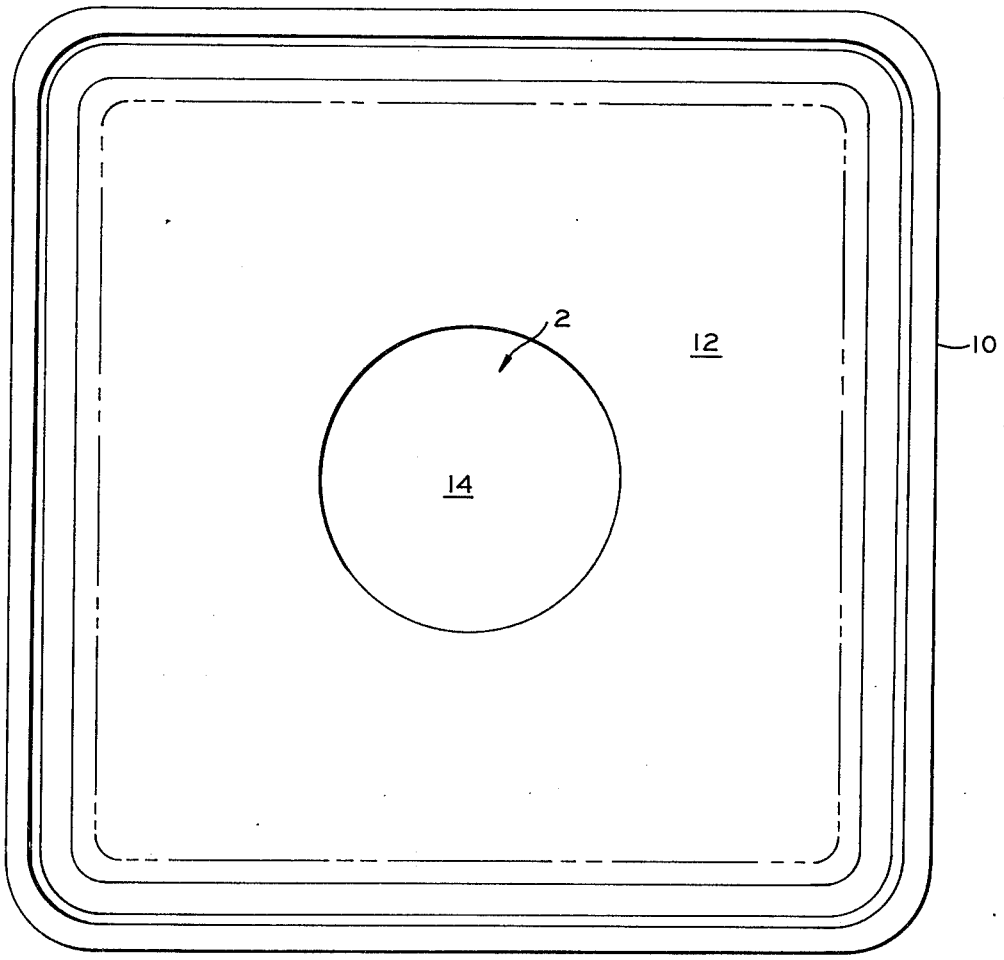

FIG. 1 shows an example side view of the container with the vessel nested therein and FIG. 2 shows a top view of said container with the vessel nested therein.

Referring to FIGS. 1 and 2, a container 2 has walls 4, a bottom 6, and a recessed portion 8, for example, a recessed top.

A vessel 10 of concave configuration is nested in the recessed portion 8 of the vessel 2. The vessel 10 has a bottom 12 having an opening 14 extending therethrough. In the nested position of the vessel 10, the bottom 12 of the vessel is in contact with the container 2.

In order to assure that material in the vessel 10 will pass into the container 2, it is preferred that the bottom 12 of the vessel 10 about said opening 14 be sealed to the recessed portion 8 of the container 2.

Materials which can be utilized for effecting this seal are, for example, pressure-sensitive adhesives, wax, a heat seal between a vessel of polyethylene and a container of polyethylene-coated paperboard, rubber cement, a soft rubber gasket, soft putty, and the like.

The recessed portion 8 of the container 2 preferably has sidewalls 16 and at least a portion of the vessel 10 extends over and is supported by said sidewalls 16. This is particularly important where a relatively large volume vessel 10 is utilized with the container 2. In such large vessels, additional support is desirable to form a more sturdy combination and support the sometimes large weight of material in the vessel without deforming the carton 2.

It is also preferred that the vessel has upper and lower sidewalls 18, 20 with at least portions of said lower sidewall 20 being angularly disposed and spaced from associated sidewalls 16 of the container recess portion 8 in the nested position of the vessel 10 in the container 2 for facilitating removal of the vessel 10 from the container recessed portion 8.

It is preferred that the container 2 be formed of paperboard which can be coated with polyethylene or an uncoated paperboard and that vessel 10 be formed of a thermoformed plastic material such as, for example, polyethylene and copolymers thereof, polypropylene, a polymer of a conjugated diolefin and a vinyl aromatic, specifically butadiene and styrene, polystyrene, polyvinyl chloride, and the like.

Further, it is preferred that means 17 be provided on sidewalls 16 and/or 18 of the vessel which indicates heights representative of preselected vessel volumes. These volume indicators 17 can be indentations or protrusions formed on the vessel sidewalls 16 and/or 18, painted lines, attached labels, or other means.

In an example use of the mixing container, dry dog food is packaged and sealed in the container 2 and the vessel 10 is nested and sealed in the recessed top portion 8 of the container 2. When it is desired to use the dry dog food, a preselected volume of water is to be added and mixed with the dog food.

In the method of the instant invention, the preselected volume of water is added to the vessel 10. The indicators 17 assist in the measurement of the proper volume of water.

Thereafter, the container 2 is perforated through the opening 14 of the vessel 10, with a knife point, for example, thereby permitting the preselected volume of water to drain by gravity from the vessel 10 into contact with the dry dog food within the container 2.

The vessel can thereafter be removed, if desirable, and, if necessary or desirable, a finger or other apparatus can be placed over the cut and the container 2 can be vigorously shaken to mix the contents together.

One example of the container would be a container of a milk carton configuration. After mixing the two or more ingredients, the milk carton can be conventionally opened via its pour spout (not shown) and the contents emptied into a serving bowl.

Other modifications and alterations of this invention will become apparent to those skilled in the art from the foregoing discussion and accompanying drawings, and it should be understood that this invention is not to be unduly limited thereto.

What is claimed is:

1. A packaging container for packaging a first material and for subsequently mixing therewith a predetermined volume of a second material, said packaging container comprising:

a sealed container having a packaging cavity for packaging said first material, said sealed container having a top member with a recessed portion formed therein, said recessed portion having sidewalls and an uninterrupted bottom member; and a concave measuring vessel removably nested in and extending above the recessed portion of said sealed container, said measuring vessel having a bottom member extending inwardly across said bottom member of said recessed portion of said sealed container, said bottom member of said measuring vessel being sealed to said bottom member of said recessed portion of said sealed container, said bottom member of said measuring vessel having an opening extending therethrough, the portion of said bottom member of said recessed portion of said sealed container below said opening being capable of being readily perforated to permit a volume of said second material contained in said measuring vessel to enter said packaging cavity and mix with the first material contained therein.

2. A container in accordance with claim 1 wherein said bottom member of said measuring vessel about said opening is adhered to said bottom member of said recessed portion of said container by means of an adhesive material.

3. A container in accordance with claim 2 wherein said adhesive material comprises a pressure sensitive adhesive.

4. A container in accordance with claim 1 wherein at least a portion of said measuring vessel extends over and is supported by said sidewalls of said recessed portion of said container.

5. A container in accordance with claim 1 wherein said measuring vessel has means on sidewalls thereof for indicating heights representative of preselected volumes.

6. A container in accordance with claim 1 wherein said measuring vessel has upper and lower sidewalls, at least a portion of said measuring vessel lower sidewalls being angularly disposed to and spaced inwardly from associated sidewalls of said recessed portion of the container when said measuring vessel is nested in said recessed portion.

7. A container in accordance with claim 1 wherein said sealed container contains said first material, wherein said first material comprises a dry material, and wherein said second material comprises a liquid.

8. A container in accordance with claim 1 wherein said container is formed of paperboard.

9. A container in accordance with claim 1 wherein said measuring vessel is of thermoformed plastic material.

10. A container in accordance with claim 9 wherein said container is formed of paperboard.

11. A container in accordance with claim 10 wherein at least a portion of said measuring vessel extends over and is supported by said sidewalls of said recessed portion of said container.

12. A container in accordance with claim 11 wherein said measuring vessel has upper and lower sidewalls, at least a portion of said measuring vessel lower sidewalls being angularly disposed to and spaced inwardly from associated sidewalls of said recessed portion of the container when said measuring vessel is nested in said recessed portion.

13. A container in accordance with claim 12 wherein said measuring vessel has means on sidewalls thereof for indicating heights representative of preselected volumes.

14. A container in accordance with claim 13 wherein the seal between said bottom member of said vessel and said top member of said container is effected by means of a pressure sensitive adhesive.

15. A container in accordance with claim 13 wherein said sealed container contains said first material, wherein said first material comprises a dry material, and wherein said second material comprises a liquid.

* * * * *